US009514677B2

(12) United States Patent
Chung et al.

(10) Patent No.: US 9,514,677 B2
(45) Date of Patent: Dec. 6, 2016

(54) DISPLAY DEVICE AND DRIVING METHOD THEREOF

(71) Applicant: Samsung Display Co., Ltd., Yongin, Gyeonggi-Do (KR)

(72) Inventors: Bo-Yong Chung, Yongin (KR); Hae-Yeon Lee, Yongin (KR); Yong-Jae Kim, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 256 days.

(21) Appl. No.: 14/041,098

(22) Filed: Sep. 30, 2013

(65) Prior Publication Data

US 2014/0354522 A1 Dec. 4, 2014

(30) Foreign Application Priority Data

Jun. 3, 2013 (KR) ..... 10-2013-0063503

(51) Int. Cl.

*G09G 3/3216* (2016.01)
*G09G 3/32* (2016.01)
*G09G 3/00* (2006.01)

(52) U.S. Cl.

CPC ..... *G09G 3/3233* (2013.01); *G09G 3/003* (2013.01); *G09G 2300/0819* (2013.01); *G09G 2300/0852* (2013.01); *G09G 2300/0866* (2013.01); *G09G 2310/0216* (2013.01); *G09G 2310/063* (2013.01); *G09G 2320/043* (2013.01)

(58) Field of Classification Search

CPC ..... G09G 2300/0819; G09G 2300/0852; G09G 2300/0866; G09G 2310/0216; G09G 2310/063; G09G 2320/043; G09G 3/003; G09G 3/3233

USPC ..... 345/690–691, 211–212, 76, 82

See application file for complete search history.

(56) References Cited

U.S. PATENT DOCUMENTS

2006/0022305 A1* 2/2006 Yamashita ..... G09G 3/2014 257/565
2011/0084947 A1* 4/2011 Chung et al. ..... 345/211
2011/0164071 A1* 7/2011 Chung et al. ..... 345/690
2012/0139905 A1* 6/2012 Hwang ..... 345/419
2012/0293479 A1* 11/2012 Han ..... G09G 3/003 345/212
2013/0069852 A1* 3/2013 Liao et al. ..... 345/77
2014/0139503 A1* 5/2014 Han ..... G09G 3/3291 345/212
2014/0139505 A1* 5/2014 Han ..... 345/212

(Continued)

FOREIGN PATENT DOCUMENTS

KR 1020050005646 1/2005
KR 1020120065137 6/2012
KR 1020120065139 6/2012

*Primary Examiner* — Quan-Zhen Wang
*Assistant Examiner* — Tony Davis
(74) *Attorney, Agent, or Firm* — F. Chau & Associates, LLC

(57) ABSTRACT

A method of driving an OLED display includes: during a scanning period of a first frame, turning off a relay transistor and turning on a switching transistor to enable a second data voltage applied to a data line to be stored in a first capacitor; and during a light emitting period of the first frame, performing an operation to turn on a light emitting transistor and a compensation transistor to enable a voltage into which a first data voltage and a threshold voltage of a driving transistor are reflected to be applied to a second node for enabling the OLED to emit light by a driving current which flows into a driving transistor. The scanning period and the light emitting period temporally overlap each other.

24 Claims, 9 Drawing Sheets

(56) References Cited

U.S. PATENT DOCUMENTS

2014/0139566 A1* 5/2014 Han ..... 345/691
2014/0313106 A1* 10/2014 In et al. ..... 345/76
2014/0313232 A1* 10/2014 Han ..... G09G 3/3696 345/690
2014/0347401 A1* 11/2014 Hwang ..... G09G 3/3233 345/690

* cited by examiner

DISPLAY DEVICE AND DRIVING METHOD THEREOF

CROSS-REFERENCE TO RELATED APPLICATION

This application claims priority to Korean Patent Application No. 10-2013-0063503 filed in the Korean Intellectual Property Office on Jun. 3, 2013, the disclosure of which is incorporated by reference in its entirety herein.

BACKGROUND (a) Technical Field

Exemplary embodiments of the present invention relate to a display device and a driving method thereof, and more particularly, to an active matrix organic light emitting diode (OLED) display device which includes a pixel including an organic light emitting diode (OLED) and a driving method thereof.

(b) Discussion of Related Art

The organic light emitting diode (OLED) display device uses an organic light emitting diode (OLED) in which a luminance is controlled by a current or a voltage. The organic light emitting diode (OLED) includes an anode layer and a cathode layer which generate an electric field and an organic light emitting material which emits light due to the electric field.

The organic light emitting diode (OLED) display device may be a passive matrix OLED (PMOLED) or an active matrix OLED (AMOLED) according to the method in which pixels of the display device are driven.

In one active matrix OLED driving scheme, one frame of the active matrix display device includes a scanning period during which image data is written and a light emitting period during which light is emitted in accordance with the written image data.

As the size of the display device is increased and the resolution is improved, the scanning period during which the image data is written is increased and a ratio of the light emitting period in one frame is reduced. Thus, the average luminance of an image may decrease. A power source voltage may be increased to increase the average luminance of the image. However, as the power source voltage is increased, a power consumption of the display device is also increased.

SUMMARY

At least one embodiments of the present invention has been made in an effort to provide a display device which includes a pixel suitable to increase a size of a display device and display a stereoscopic image with a high resolution and a driving method thereof.

An exemplary embodiment of the present invention provides a display device including a plurality of pixels. Each of the plurality of pixel includes: a switching transistor which includes a gate electrode to which a scan signal is applied, an electrode which is connected to the data line, and another electrode which is connected to the first node; a relay transistor which includes a gate electrode to which a writing signal is applied, an electrode which is connected to the first node, and another electrode which is connected to a second node; a driving transistor which includes a gate electrode which is connected to the second node, an electrode which is connected to a third node, and another electrode which is connected to an organic light emitting diode; a first capacitor which includes an electrode which is connected to the third node and another electrode which is connected to a fourth node; a compensation transistor which includes a gate electrode to which a light emitting signal is applied, an electrode which is connected to the second node, and another electrode which is connected to the fourth node; a reset transistor which includes a gate electrode to which a reset signal is applied, an electrode which is connected to the data line, and another electrode which is connected to the fourth node; and a light emitting transistor which includes a gate electrode to which the light emitting signal is applied, one electrode which is connected to a first power source voltage, and another electrode which is connected to the third node.

Each of the plurality of pixels may further include a second compensation transistor which includes a gate electrode to which the writing signal is applied, an electrode to which the writing signal is applied, and another electrode which is connected to another electrode of the driving transistor.

Each of the plurality of pixels may further include a second light emitting transistor which includes a gate electrode to which the light emitting signal is applied, an electrode which is connected to another electrode of the driving transistor, and another electrode which is connected to the organic light emitting diode.

Each of the plurality of pixels may further include a second compensation transistor which includes a gate electrode to which the writing signal is applied, an electrode which is connected to an initializing voltage, and another electrode which is connected to another electrode of the driving transistor.

Each of the plurality of pixels may further include a second light emitting transistor which includes a gate electrode to which the light emitting signal is applied, an electrode which is connected to another electrode of the driving transistor, and another electrode which is connected to the organic light emitting diode.

The display device may further include a second capacitor which includes an electrode which is connected to the first node and another electrode which is connected to an initializing voltage. During an operation when the light emitting transistor and the compensation transistor are turned on and a voltage into which a first data voltage and a threshold voltage Vth of the driving transistor are reflected is applied to the second node, when a light emitting period when the organic light emitting diode emits light by a driving current which flows into the driving transistor is simultaneously performed in the plurality of pixels, a second data voltage corresponding to a scan signal set to a gate on voltage corresponding to each of the plurality of pixels is stored in the first capacitor.

The second data voltage may be a data voltage which is written into each of the plurality of the pixels in a current frame and the first data voltage may be a data voltage which is written into each of the plurality of pixels in an immediately previous frame of the current frame.

In an exemplary embodiment, after the second data voltage is applied to the second node and a voltage into which the second data voltage and the threshold voltage of the driving transistor are formed in the third node, when the light emitting transistor and the compensation transistor are turned on, the voltage into which the data voltage and the threshold voltage of the driving transistor are reflected is applied to the second node by coupling of the first capacitor.

An exemplary embodiment of the present invention provides a driving method of a display device having a plurality of pixels, where each pixel includes a switching transistor connected between a data line and the first node, a first capacitor connected between the first node and an initializing voltage, a relay transistor connected between the first node and the second node, a driving transistor which includes a gate electrode connected to the second node and controls a driving current flowing in an organic light emitting diode (OLED) by a first power source voltage applied to a third node, a light emitting transistor connected between a first power source voltage and the third node, a second capacitor connected between the third node and a fourth node, and a compensation transistor which is connected between the second node and the fourth node. The method includes during a scanning period of a first frame, turning off the relay transistor and turning on the switching transistor to enable a second data voltage applied to the data line to be stored in the first capacitor; and during a light emitting period of the first frame, performing an operation to turn on the light emitting transistor and the compensation transistor to enable a voltage into which a first data voltage and a threshold voltage of the driving transistor are reflected to be applied to the second node for enabling the organic light emitting diode OLED to emit light by a driving current which flows into the driving transistor. The scanning period and the light emitting period temporally overlap each other.

The operation may be simultaneously performed in the plurality of pixels.

The second data voltage may be a data voltage which is written into each of the plurality of pixels in a current frame and the first data voltage may be a data voltage which is written into each of the plurality of pixels in an immediately previous frame of the current frame.

The driving method may further include resetting a gate voltage of the driving transistor to an initializing voltage of a low level voltage.

The resetting may further include applying the initializing voltage to the data line and turning on the reset transistor and the compensation transistor to apply the initializing voltage which is applied to the data line to the gate electrode of the driving transistor.

The resetting may further include applying the first power source voltage and the second power source voltage which is connected to a cathode of the organic light emitting diode (OLED) as high level voltages and applying a first power source voltage to an anode of the organic light emitting diode (OLED) when the light emitting transistor is turned on.

The driving method may further include before the scanning period, during a compensating operation in which the first data voltage which is stored in the first capacitor is applied to the second node and a voltage into which the first data voltage and the threshold voltage of the driving transistor are reflected is applied to the third node.

The compensation operation may further include applying a reference voltage to the data line and turning on the reset transistor to apply the reference voltage to the fourth node.

The compensation operation may further include allowing a current to flow into the driving transistor until a second power source voltage which is applied to the cathode of the organic light emitting diode OLED is changed from the high level voltage into a low level voltage and a voltage of the third node becomes the first data voltage and the threshold voltage of the driving transistor.

The compensation operation may further include turning on a second compensation transistor connected between the writing signal and the organic light emitting diode (OLED) to apply the writing signal to an anode of the organic light emitting diode (OLED).

The compensation operation may further include turning on a second light emitting transistor connected between the driving transistor and the organic light emitting diode (OLED).

The compensation operation may further include turning on a second compensation transistor connected between the writing signal and the organic light emitting diode (OLED) to apply the initializing signal to the anode of the organic light emitting diode (OLED) and turning on a second light emitting transistor connected between the driving transistor and the organic light emitting diode (OLED).

According to an exemplary embodiment of the present invention, a display device includes a pixel having first through sixth transistors and an organic light emitting diode OLED. The first and fifth transistors are connected to a data line, and a gate electrode of the first transistor is connected to a scan line. The display device further includes a power supply configured to provide a first power supply voltage to the sixth transistor and a second power supply voltage to the OLED and a controller configured to provide a scan signal to the scan line, a first signal to a gate terminal of the second transistor, a second signal to gate electrodes of the fourth and sixth transistors, and a third signal to a gate terminal of the fifth transistor.

In an exemplary embodiment, the first transistor is connected to a first node, the second transistor is connected between the first node and a second node, the third transistor is connected between the OLED and a third node, the fourth transistor is connected between the second node and a fourth node, the fifth transistor is connected to the fourth node, and the sixth transistor is connected to the third node.

In an exemplary embodiment, the pixel further includes a first capacitor connected to the first node and a second capacitor connected between the third and fourth nodes. The display device may include several such pixels.

In an exemplary embodiment, during an entire light emitting period the first and third signals have a first logic level and the second signal has a second other logic level, during a first part of the period the scan signal has a gate off voltage, during a second part of the period the scan signal has a gate on voltage, and during a third part of the period the scan signal has the gate off voltage. In an exemplary embodiment, during the first part a constant high voltage is applied to the data line, during the second part a voltage with one among a plurality of levels representing a gray level of the pixel is applied to the data line, and during the third part a constant low voltage is applied to the data line A pixel according to at least one embodiment of the inventive concept may sufficiently ensure a ratio of the light emitting period in one frame. Further, at least one embodiment of the pixel may allow the display device to have a larger size and display a stereoscopic image with a higher resolution.

DETAILED DESCRIPTION

Figure 1:
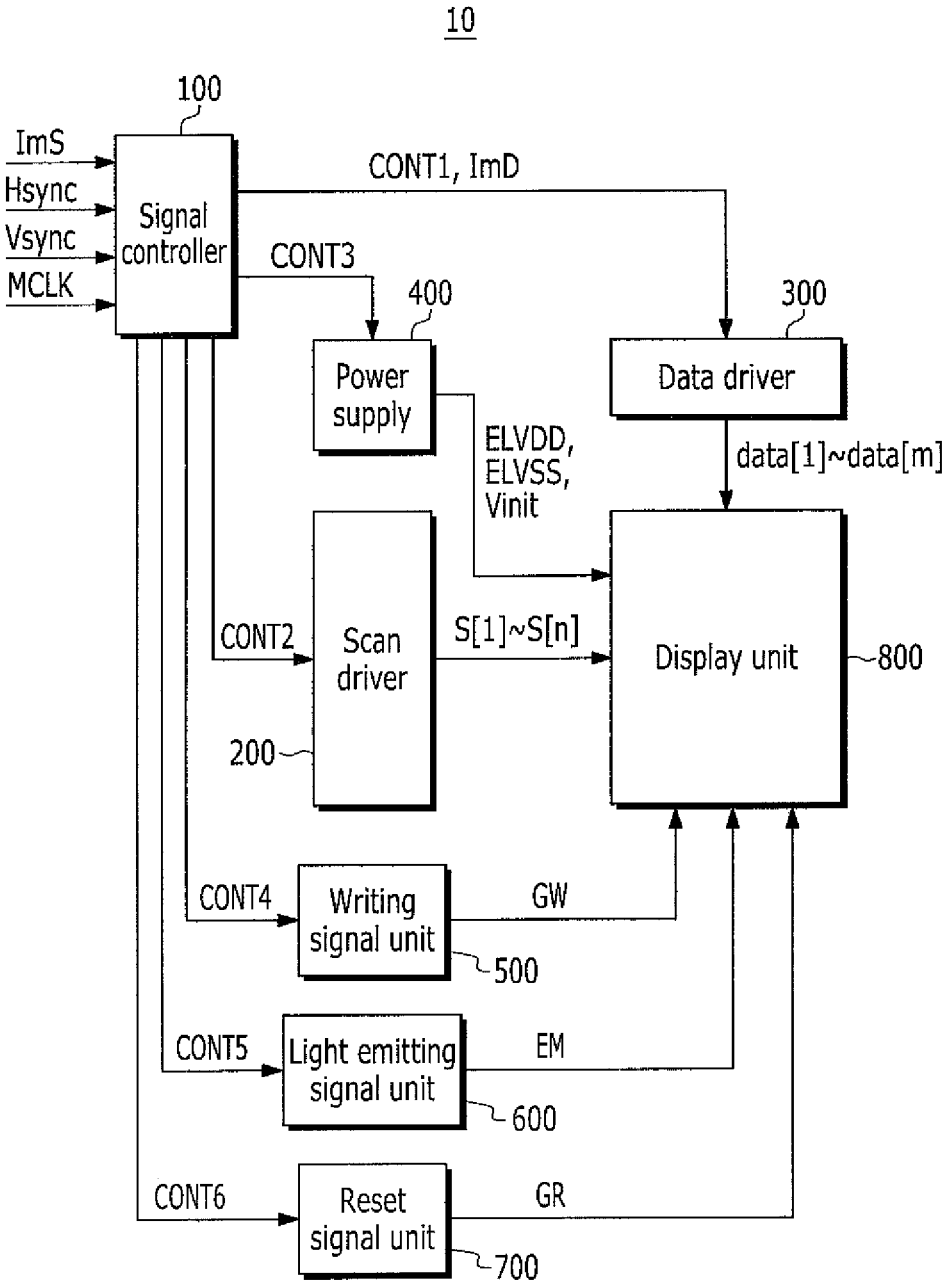
FIG. 1 is a block diagram illustrating a display device according to an exemplary embodiment of the invention.

In the following detailed description, only certain exemplary embodiments of the present invention have been shown and described, by way of illustration. However, the described embodiments may be modified in various different ways, all without departing from the spirit or scope of the present invention. Like reference numerals designate like elements throughout the specification.

It will be understood that when an element is referred to as being "coupled" to another element, the element may be "directly coupled" to the other element or "electrically coupled" to the other element through a third element. As used herein, the singular forms "a", "an" and "the" are intended to include the plural forms as well, unless the context indicates otherwise.

FIG. 1 is a block diagram illustrating a display device according to an exemplary embodiment of the invention.

Referring to FIG. 1, the display device 10 includes a signal controller 100, a scan driver 200, a data driver 300, a power supply 400, a writing signal unit 500, a light emitting signal unit 600, a reset signal unit 700, and a display unit 800. In an exemplary embodiment, a unit, a controller, or a driver includes one or more processes or logic circuits to accomplish a function (e.g., generate a signal, perform an operation, etc.). The power supply 400 may include one or more voltage generators or boosting circuits to generate its output power supply voltages.

The signal controller 100 receives an image signal Ims and a synchronization signal, which are input from an external device. The input image signal ImS has luminance information of a plurality of pixels. The luminance information may include a predetermined number of gray scales, for example, $1024=2^{10}$, $256=2^{8}$ or $64=2^{6}$ gray scales. For example, the luminance information may indicate the gray level or color of each pixel of the display unit 800. The synchronization signal includes a horizontal synchronization signal Hsync, a vertical synchronization signal Vsync, and a main clock signal MCLK.

The signal controller 100 generates first to sixth driving control signals CONT1, CONT2, CONT3, CONT4, CONT5, and CONT6 and the image data signal ImD in accordance with the image signal ImS, the horizontal synchronization signal Hsync, the vertical synchronization signal Vsync, and the main clock signal MCLK.

The signal controller 100 divides the image signal Ims into units of frames in accordance with the vertical synchronization signal Vsync and divides the image signal Ims into units of scan lines in accordance with the horizontal synchronization signal Hsync to generate the image data signal ImD. The signal controller 100 transmits the image data signal ImD and the first driving control signal CONT1 together to the data driver 300.

The display unit 800 is a display area including a plurality of pixels. In the display unit 800, a plurality of scan lines and a plurality of data lines are connected to the pixels. The plurality of scan lines may extend substantially in a row direction to be substantially parallel to each other and the plurality of data lines may extend substantially in a column direction to be substantially parallel to each other. The display unit 800 may further include a plurality of power source lines, a plurality of writing signal lines, a plurality of light emitting signal lines, and a plurality of reset signal lines connected to the plurality of pixels. The plurality of pixels may be arranged approximately in a matrix.

The scan driver 200 is connected to the plurality of scan lines and generates a plurality of scan signals S[1] to S[n] in accordance with a second driving control signal CONT2. The scan driver 200 may sequentially apply the scan signals Sill to S[n] of a gate on voltage to the plurality of scan lines.

The data driver 300 is connected to the plurality of data lines and samples and holds the image data signal ImD input in accordance with the first driving control signal CONT1 and transmits a plurality of data signals data[1] to data[m] to the plurality of data lines. The data driver 300 applies data signals data[1] to data[m] having a predetermined voltage range to the plurality of data lines in accordance with the scan signals S[1] to S[n] of the gate on voltage.

The power supply 400 is connected to the plurality of power source lines and supplies a first power source voltage ELVDD, a second power source voltage ELVSS, and an initializing voltage Vinit to the plurality of pixels. The power supply 400 adjusts a power level of the first power source voltage ELVDD and the second power source voltage ELVSS in accordance with a third driving control signal CONT3.

The writing signal unit 500 is connected to the plurality of writing signal lines and generates a writing signal GW in accordance with a fourth driving control signal CONT4. The writing signal unit 500 may simultaneously apply the writing signal GW of the gate on voltage to the plurality of pixels.

The light emitting signal unit 600 is connected to the plurality of light emitting signal lines and generates a light emitting signal EM in accordance with a fifth driving control signal CONT5. The light emitting signal unit 600 may simultaneously apply the light emitting signal EM of the gate on voltage to the plurality of pixels.

The reset signal unit 700 is connected to the plurality of reset signal lines and generates a reset signal GR in accordance with a sixth driving control signal CONT6. The reset signal unit 700 may simultaneously apply the reset signal GR of the gate on voltage to the plurality of pixels.

While FIG. 1 has illustrated separate units 200, 400, 500, 600, and 700 for supplying power supply voltages, scan signals, a writing signal GW, a light emission signal EM, and a reset signal GR, one or more of these units may combined together so that a single unit provides several of the signals together. For example, in an exemplary embodiment, a single controller provides the writing signal GW, the light emission signal EM, and the reset signal Gr.

Figure 2:
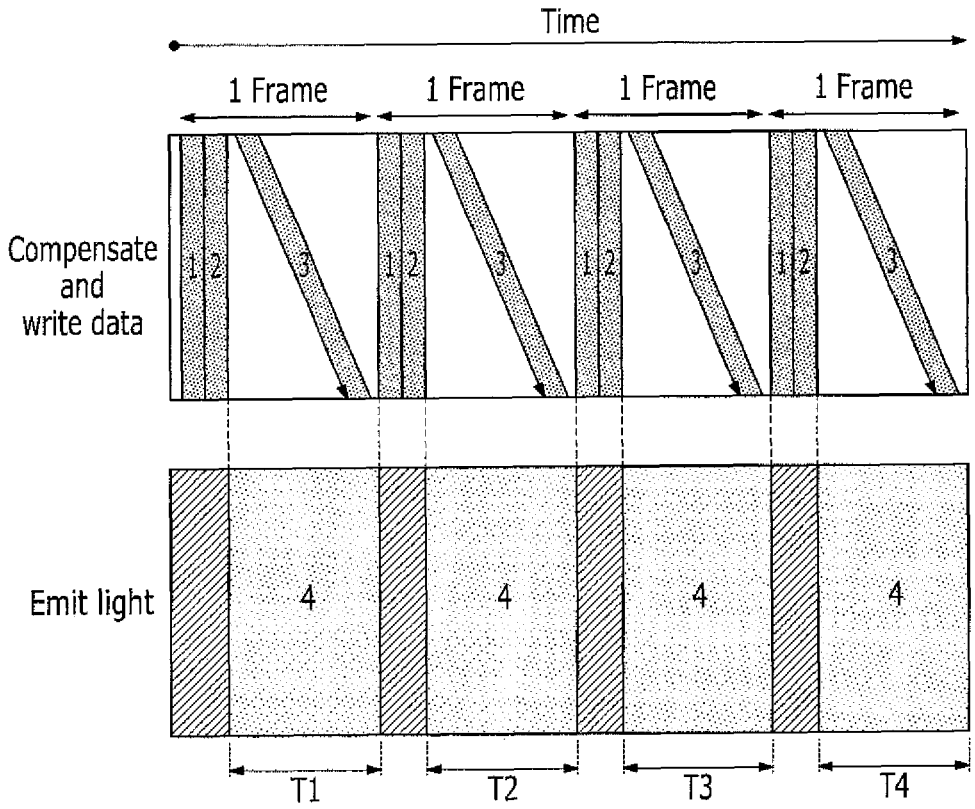
FIG. 2 is a diagram illustrating a driving method of a display device according to an exemplary embodiment of the present invention.

FIG. 2 is a diagram illustrating a driving method of a display device according to an exemplary embodiment of the present invention.

Referring to FIG. 2, one frame period when one image is displayed on the display unit 800 includes a reset period 1 when a driving voltage of an organic light emitting diode (OLED) of a pixel is reset, a compensating period 2 where a threshold voltage of a driving transistor of the pixel is compensated, a scanning period 3 when data is written into each of the plurality of pixels, and a light emitting period 4 when the pixels emit the light in accordance with written data. Temporally, the scanning period 3 and the light emitting period 4 overlap.

During the light emitting period 4 of the current frame, the pixels emit light in accordance with the data written during the scanning period 3 of the immediate frame. Further, the pixels emit the light during the light emitting period 4 of a next frame in accordance with data written into the pixels during the scanning period 3 of the current frame.

For example, it is assumed that a period T1 includes a scanning period 3 and a light emitting period 4 of an N-th frame. Data which is written into the pixels during the scanning period 3 of the period T1 is data of the N-th frame and the pixels emit light during the light emitting period 4 of the period T1 in accordance with data of an N−1-st frame which is written into the scanning period D of the N−1-st frame.

A period T2 includes a scanning period 3 and a light emitting period 4 of an N+1-st frame. Data which is written into the pixels during the scanning period 3 of the period T2 is data of the N+1-st frame and the pixels emit light during the light emitting period 4 of the period T2 in accordance with data of an N-th frame which is written during the scanning period 3 of the N-th frame, that is, the period T1.

A period T3 includes a scanning period 3 and a light emitting period 4 of an N+2-nd frame. Data which is written into the pixels during the scanning period 3 of the period T3 is data of the N+2-nd frame and the pixels emit light during the light emitting period 4 of the period T3 in accordance with data of an N+1-st frame which is written during the scanning period 3 of the N+1-st frame, that is, the period T2.

A period T4 includes a scanning period 3 and a light emitting period 4 of an N+3-rd frame. Data which is written into the pixels during the scanning period 3 of the period T4 is data of the N+3-rd frame and the pixels emit light during the light emitting period 4 of the period T4 in accordance with data of an N+2-nd frame which is written during the scanning period 3 of the N+2-nd frame, that is, the period T3.

A pixel structure in which the data of the current frame is written during the scanning period 3 and light is emitted in accordance with data of an immediately previous frame during the light emitting period 4 which overlaps the scanning period 3 will be described with reference to FIG. 3.

Figure 3:
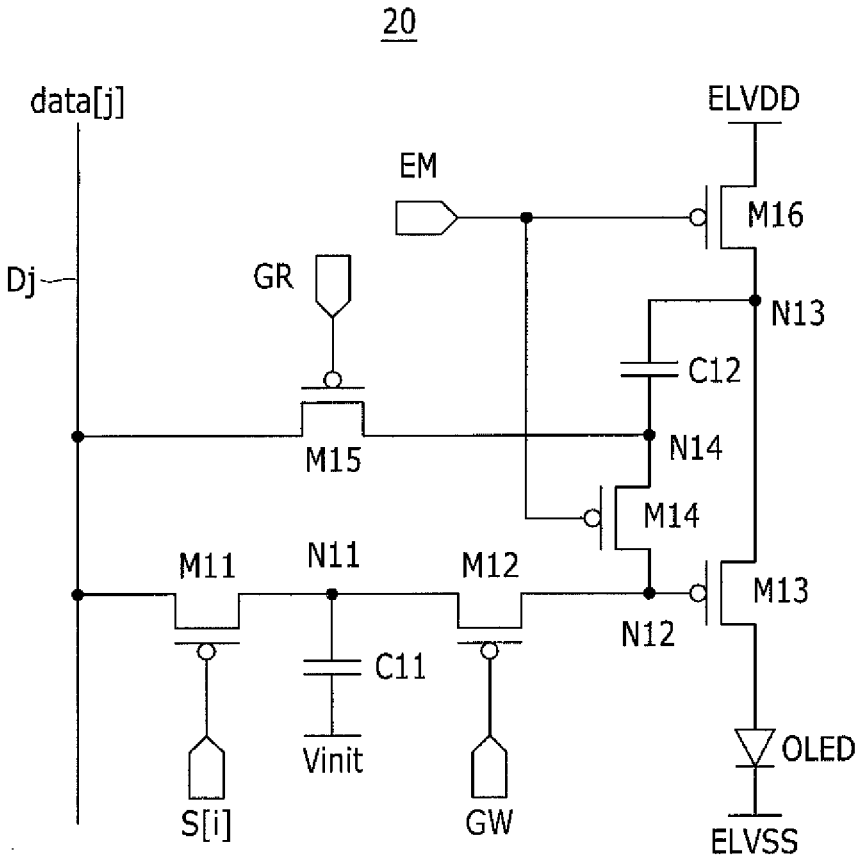
FIG. 3 is a circuit diagram illustrating a pixel according to an exemplary embodiment of the present invention.

FIG. 3 is a circuit diagram illustrating a pixel according to an exemplary embodiment of the present invention.

Referring to FIG. 3, a pixel 20 according to an exemplary embodiment of the invention includes a switching transistor M11, a relay transistor M12, a driving transistor M13, a compensation transistor M14, a reset transistor M15, a light emitting transistor M16, a first capacitor C11, a second capacitor C12, and an organic light emitting diode (OLED).

The switching transistor M11 includes a gate electrode to which a scan signal S[i] is applied, an electrode which is connected to a data line Dj, and another electrode which is connected to a first node N11. The switching transistor M11 is turned on by the scan signal S[ ] set to a gate on voltage to apply a voltage which is applied to the data line Dj to the first node N11.

The relay transistor M12 includes a gate electrode to which a writing signal GW is applied, an electrode which is connected to the first node N11, and another electrode which is connected to a second node N12. The relay transistor M12 is turned on by the writing signal GW set to the gate on voltage to apply a voltage of the first node N11 to the second node N12.

The driving transistor M13 includes a gate electrode which is connected to the second node N12, an electrode which is connected to a third node N13, and another electrode which is connected to an anode electrode of the organic light emitting diode OLED. The driving transistor M13 is turned on/off by a voltage of the second node N12 to control a driving current which is supplied to the organic light emitting diode OLED.

The compensation transistor M14 includes a gate electrode to which a light emitting signal EM is applied, an electrode which is connected to the second node N12, and another electrode which is connected to a fourth node N14.

The reset transistor M15 includes a gate electrode to which a reset signal GR is applied, an electrode which is connected to the data line Dj, and another electrode which is connected to the fourth node N14. The reset transistor M15 is turned on by the reset signal GR set to the gate on voltage to apply a voltage which is applied to the data line Dj to the fourth node N14.

The light emitting transistor M16 includes a gate electrode to which the light emitting signal EM is applied, an electrode which is connected to a first power source voltage ELVDD, and another electrode which is connected to the third node N13.

The first capacitor C11 includes an electrode which is connected to the first node N11 and another electrode which is connected to an initializing voltage Vinit.

The second capacitor C12 includes an electrode which is connected to the third node N13 and another electrode which is connected to the fourth node N14.

The organic light emitting diode OLED includes an anode electrode which is connected to another electrode of a driving transistor M13 and a cathode electrode which is connected to a second power source voltage ELVSS. The organic light emitting diode OLED may emit light with one of a plurality of primary colors. Examples of the primary color include three primary colors such as red, green and blue and a desired color may be displayed and spatial sum or a temporal sum of the three primary colors may display a desired color.

The switching transistor M11, the relay transistor M12, the driving transistor M13, the compensation transistor M14, the reset transistor M15 and the light emitting transistor M16 may be p-channel field effect transistors. In this case, a gate on voltage at which the switching transistor M11, the relay transistor M12, the driving transistor M13, the compensation transistor M14, the reset transistor M15, and the light emitting transistor M16 are turned on is a low level voltage and a gate off voltage at which the transistors are turned off is a high level voltage.

Here, the p-channel field effect transistor is described but at least one of the switching transistor M11, the relay transistor M12, the driving transistor M13, the compensation transistor M14, the reset transistor M15, and the light emitting transistor M16 may be an n-channel field effect transistor. In this case, the gate on voltage at which the n-channel field effect transistor is turned on is a high level voltage and the gate off voltage at which the n—channel field effect transistor is turned off is a low level voltage.

Figure 4:
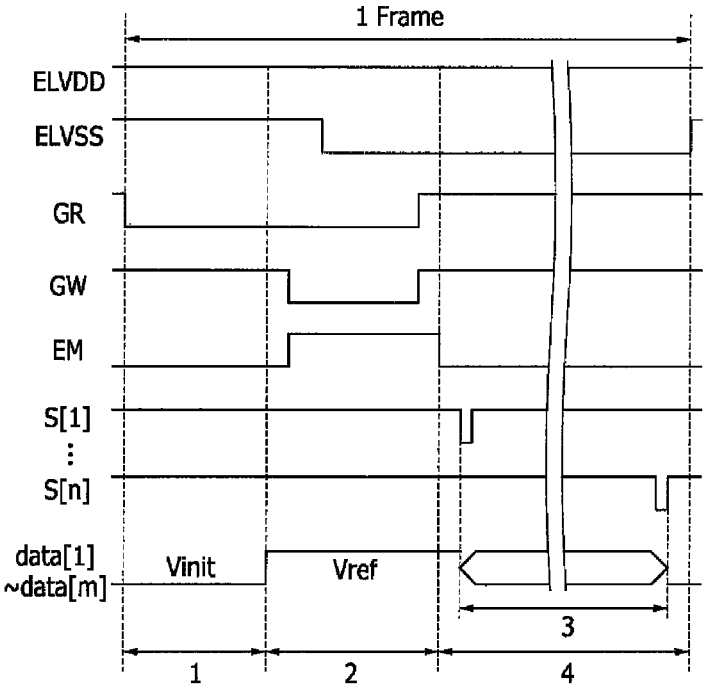
FIG. 4 is a timing chart illustrating a driving method of a display device according to an exemplary embodiment of the present invention.

FIG. 4 is a timing chart illustrating a driving method of a display device according to an exemplary embodiment of the present invention.

Referring to FIGS. 3 and 4, a driving method of a display device 10 including the pixel 20 according to an exemplary embodiment will be described.

During the reset period 1, a first power source voltage ELVDD and a second power source voltage ELVSS are applied as high level voltages. The reset signal GR and the light emitting signal EM are applied at the gate on voltage and the writing signal GW and the scan signals S[1] to S[n] are applied at the gate off voltage. In this case, the data signals data[1] to data[m] are applied at the initializing voltage Vinit. The initializing voltage Vinit may be a lowest voltage among a range of voltages that represent a gray level of a pixel, or the initializing voltage Vinit may be a voltage lower than the lowest voltage to distinguish it from a valid data voltage. The reset transistor M15 is turned on by the reset signal GR set to the gate on voltage and the initializing voltage Vinit of the data line Dj is applied to the fourth node N14 through the turned-on reset transistor M15. The compensation transistor M14 and the light emitting transistor M16 are turned on by the light emitting signal EM set to the gate on voltage. When the compensation transistor M14 is turned on, the second node N12 and the fourth node N14 are connected and the initializing voltage Vinit which is applied to the fourth node N14 is applied to the second node N12. The initializing voltage Vinit may be a low level voltage. The first power source voltage ELVDD is applied to the third node N13 through the turned-on light emitting transistor M16. The driving transistor M13 is turned on, and the first power source voltage ELVDD is transmitted to the anode of the organic light emitting diode OLED. In this case, the second power source voltage ELVSS is applied as a high level voltage so that no current flows into the organic light emitting diode OLED. As described above, the gate voltage of the driving transistor M13, that is, a voltage of the second node N12 is reset as the initializing voltage Vinit and the anode voltage of the organic light emitting diode OLED is reset as a high level voltage.

During the compensating period 2, the data signals data [1] to data[m] are changed into a reference voltage Vref. The reference voltage Vref may be a highest voltage among a range of voltages that represent a gray level of a pixel, or a voltage higher than the highest voltage to distinguish it from a valid data voltage. The reference voltage Vref may be a high level voltage. In this case, the reset transistor M15 is maintained to be turned on and the reference voltage Vref is applied to the fourth node N14 through the reset transistor M15. In this case, the light emitting signal EM is applied as a gate off voltage and the compensation transistor M14 and the light emitting transistor M16 are turned off by the light emitting signal EM of the gate off voltage. The writing signal GW is applied as a gate on voltage and the relay transistor M12 is turned on by the writing signal GW of the gate on voltage. The data voltage data which is stored in the first capacitor C11 is applied to the second node N12 through the turned-on relay transistor M12. The data voltage data which is stored in the first capacitor C11 is a data voltage which is stored in the first capacitor C11 during the scanning period 3 of the immediately previous frame of the current frame. Thereafter, when the second power source voltage ELVSS is changed into a low level voltage, a voltage of the anode electrode of the organic light emitting diode OLED drops to a low level voltage due to coupling of a parasitic capacitor of the organic light emitting diode OLED. When a voltage of the anode of the organic light emitting diode OLED drops to a low level voltage, the current flows from the third node N13 to the organic light emitting diode OLED through the driving transistor M13 until the voltage of the third node N13 becomes a data-Vth voltage, and a voltage of the third node N13 becomes the data-Vth voltage. Here, the data refers to a voltage of the data signals data[ ] to data[m]. Vth may have a negative value as a threshold voltage of the driving transistor M13. That is, the voltage of the third node N13 becomes a voltage into which the data voltage data and a threshold voltage Vth of the driving transistor M13 are reflected.

During the light emitting period 4, the first power source voltage ELVDD is applied as a high level voltage and the second power source voltage ELVSS is applied as a low level voltage. The reset signal GR and the writing signal GW are applied as the gate off voltage and the light emitting signal EM is applied as the gate on voltage. As the light emitting signal EM is applied as a gate on voltage, the compensation transistor M14 and the light emitting transistor M16 are turned on. The first power source voltage ELVDD is transmitted to the third node N13 through the turned-on light emitting transistor M16. The voltage of the third node N13 is changed into the ELVDD voltage at a data+Vth voltage. Here, ELVDD refers to a high level voltage of the first power source voltage ELVDD. As the voltage of the third node N13 is changed into the ELVDD voltage, the voltage of the fourth node N14 is changed by an ELVDD−(data−Vth) voltage by coupling the second capacitor C12 so that the voltage of the fourth node N14 becomes an ELVDD−(data−Vth)+Vref voltage. The voltage of the fourth node N14 is transmitted to the second node N12, that is, the gate electrode of the driving transistor M13 through the turned-on compensation transistor M14. That is, a voltage into which the data voltage data and the threshold voltage Vth of the driving transistor M13 are reflected is applied to the second node N12. The driving transistor M13 is turned on by a difference of the gate-source voltages (e.g., Vgs) and a driving current Ioled flows through the driving transistor M13. The driving current lobed becomes $k*(Vgs-Vth)^2=k*(((ELVDD-(data-Vth)+Vref)-ELVDD)-Vth)^2=k*(Vref-data)^2$. Here, k is a parameter which is determined by a characteristic of the driving transistor M13.

The driving current Ioled flows into the organic light emitting diode OLED and the organic light emitting diode OLED emits light at a brightness corresponding to the driving current Ioled. The organic light emitting diode OLED may emit light at a brightness corresponding to the data voltage data regardless of the voltage drop of the first source voltage EVDD and the threshold voltage Vth of the driving transistor M13. When the second power source voltage ELVSS is changed into a high level voltage, no current flows into the organic light emitting diode OLED and the light emitting period 4 ends.

During the scanning period 3, the plurality of scan signals S[1] to S[n] is sequentially applied as the gate on voltage and the data signals data[1] to data[m] in a predetermined voltage range are applied so as to correspond to the plurality of scan signals S[1] to S[n]. In this case, the reset signal GR and the writing signal GW are applied as the gate off voltage and the relay transistor M12 and the reset transistor M15 are turned off. The switching transistor M11 is turned on by the scan signal S[i] of the gate on voltage and the data voltage data is applied to the first node N11 through the turned-on switching transistor M11. The Vinit-data voltage is stored in the first capacitor C11. The voltage which is stored in the first capacitor C11 is used during the light emitting period 4 of a subsequent frame.

The scanning period 3 and light emitting period 4 overlap with one another in FIG. 4 During a first part of the light emitting period 4, all the data signals are set to a same constant reference voltage Vref and all of the scan signals applied to each scan line are set to a gate off voltage, during a second later part of the light emitting period 4, the data signals are set to voltages that are representative of gray levels of corresponding pixels, and during a third later part of the light emitting period 4, all of the scan signals are again set to the gate off voltage and all the data signals are set to a constant initial voltage Vinit that is lower than the reference voltage Vref.

As described above, the display device 10 which includes the pixel 20 according to an exemplary embodiment may simultaneously perform a data writing operation and the light emitting operation so that data writing time may be sufficiently secured.

Figure 5:
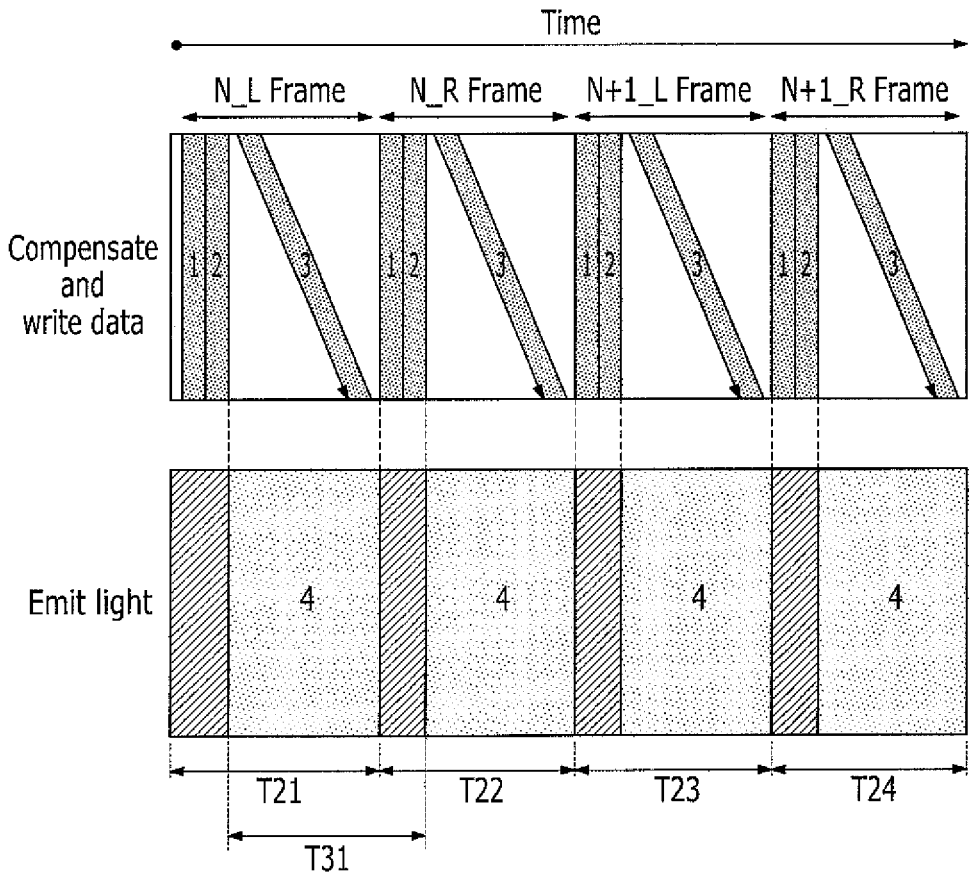
FIG. 5 is a diagram illustrating a driving method of a display device according to an exemplary embodiment of the present invention.

FIG. 5 is a diagram illustrating a driving method of a display device according to an exemplary embodiment of the present invention.

Referring to FIG. 5, the display device 10 alternately displays a left-eye image and a right-eye image in accordance with a shutter spectacles method. As illustrated in FIG. 5, each frame includes a reset period 1, a compensating period 2, a scanning period 3, and a light emitting period 4.

A frame where a plurality of data signals (hereinafter, referred to as a left eye image data signal) which indicate a left-eye image is written into each of the plurality of pixels is denoted by the reference numeral 'L' and a frame where a plurality of data signals (hereinafter, referred to as a right eye image data signal) which indicates a right-eye image is written into each of the plurality of pixels is denoted by the reference numeral 'R'.

In each of the reset period 1, the compensating period 2, the scanning period 3, and the light emitting period 4, waveforms of the reset signal GR, the writing signal GW, the light emitting signal EM, the scan signals S[1] to S[n], and the data signals data[1] to data[m] are the same as the waveforms illustrated in FIG. 4 and thus detailed description of the periods will be omitted.

During the scanning period 3 of a period T21, the left eye image data signal of the N_L frame is written into the plurality of pixels. During the scanning period 3, the left eye image data signals corresponding to the plurality of pixels are written. In this case, during the light emitting period 4 of the period T21, the plurality of pixels emit light in accordance with the right eye image data signal which is written during the light emitting period 3 of an N−1_R frame.

During the scanning period 3 of a period T22, the right eye image data signal of the N_L frame is written into the plurality of pixels. During the scanning period 3, the right eye image data signals corresponding to the plurality of pixels are written. In this case, during the light emitting period 4 of the period T22, the plurality of pixels emit light in accordance with the left eye image data signal which is written during the light emitting period 3 of an N_L frame.

During the scanning period 3 of a period T23, the left eye image data signal of the N+1_L frame is written into the plurality of pixels. During the scanning period 3, the left eye image data signals corresponding to the plurality of pixels are written. In this case, during the light emitting period 4 of the period T23, the plurality of pixels emit light in accordance with the right eye image data signal which is written during the scanning period 3 of an N_R frame.

During the scanning period 3 of a period T24, the right eye image data signal of the N+1_R frame is written into the plurality of pixels. During the scanning period 3, the right eye image data signals corresponding to the plurality of pixels are written. In this case, during the light emitting period 4 of the period T24, the plurality of pixels emit light in accordance with the left eye image data signal which is written during the scanning period 3 of an N+1_L frame.

While the left-eye image is written in accordance with the above-described manner, the right-eye image emits light simultaneously with the left-eye image and also while the right-eye image is written, the left-eye image emits light simultaneously with the right-eye image. By doing this, the light emitting period may be sufficiently ensured so that the image quality of a stereoscopic image (e.g., perceived as a 3D image) is improved.

Since the scanning period 3 and the light emitting period 4 belong to the same period, an interval T31 between the light emitting periods 4 of the frames may be set regardless of the scanning period. In this case, the interval T31 between the light emitting periods 4 may be set to be optimized with a liquid crystal response speed of the shutter spectacles.

When the scanning period 3 and the light emitting period 4 do not belong to the same period, the light emitting period 4 follows the scanning period 3 so that a temporal margin in which the light emitting period 4 is set during one frame period is narrow. In a driving method according to an exemplary embodiment of the invention, the light emitting period 4 is set in a period that excludes the reset period 1 and the compensating period 2 during one frame period. Accordingly, the temporal margin in which the light emitting period 4 is set is increased so that the interval T31 between the light emitting periods 4 may be set in consideration of the liquid crystal response speed of the shutter spectacles.

For example, the interval T31 between the light emitting periods 4 is set in consideration of a time required for completely opening a right eye lens (or a left eye lens) of the shutter spectacles from the time when the light emitting of the left-eye image (or right-eye image) ends.

Figure 6:
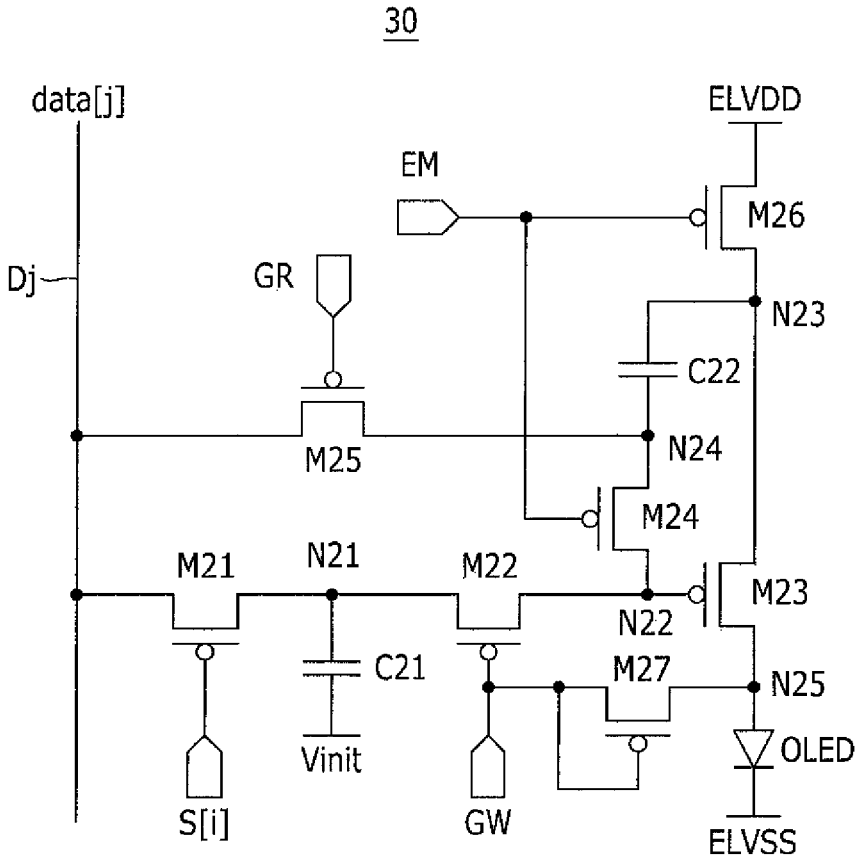
FIG. 6 is a circuit diagram illustrating a pixel according to an exemplary embodiment of the present invention.

FIG. 6 is a circuit diagram illustrating a pixel according to an exemplary embodiment of the present invention.

Referring to FIG. 6, a pixel 30 according to an exemplary embodiment includes a switching transistor M21, a relay transistor M22, a driving transistor M23, a first compensation transistor M24, a reset transistor M25, a light emitting transistor M26, a second compensation transistor M27, a first capacitor C21, a second capacitor C22, and an organic light emitting diode OLED.

Different from the pixel 20 illustrated in FIG. 3, the pixel 30 illustrated in FIG. 6 further includes the second compensation transistor M27.

The second compensation transistor M27 includes a gate electrode to which a writing signal GW is applied, an electrode to which the writing signal GW is applied, and another electrode which is connected to a fifth node N25. Another electrode of the driving transistor M23 and an anode of the organic emitting diode OLED are connected to the fifth node N25. The second compensation transistor M27 is turned on by the writing signal GW set to the gate on voltage to apply the writing signal GW set to the gate on voltage to the fifth node N25.

The second compensation transistor M27 may be a p-channel field effect transistor. Here, even though it is described that the second compensation transistor M27 is a p-channel field effect transistor, the second compensation transistor M27 may be an n-channel field effect transistor.

The pixel 30 according to an exemplary embodiment may be driven in accordance with the waveform diagram illustrated in FIG. 4.

However, during the compensating period 2, the second compensation transistor M27 is turned on by the writing signal GW set to the gate on voltage and the writing signal GW set to the gate on voltage (e.g., a low level voltage) is applied to the fifth node N25 through the turned-on second compensation transistor M27. The voltage of the fifth node N25 becomes a low level voltage and the voltage of the third node N23 becomes the data-Vth voltage.

Other operations are the same as those described with reference to FIG. 4 and thus the detailed description of the driving method of the display device which includes the pixel 30 illustrated in FIG. 6 will be omitted.

Figure 7:
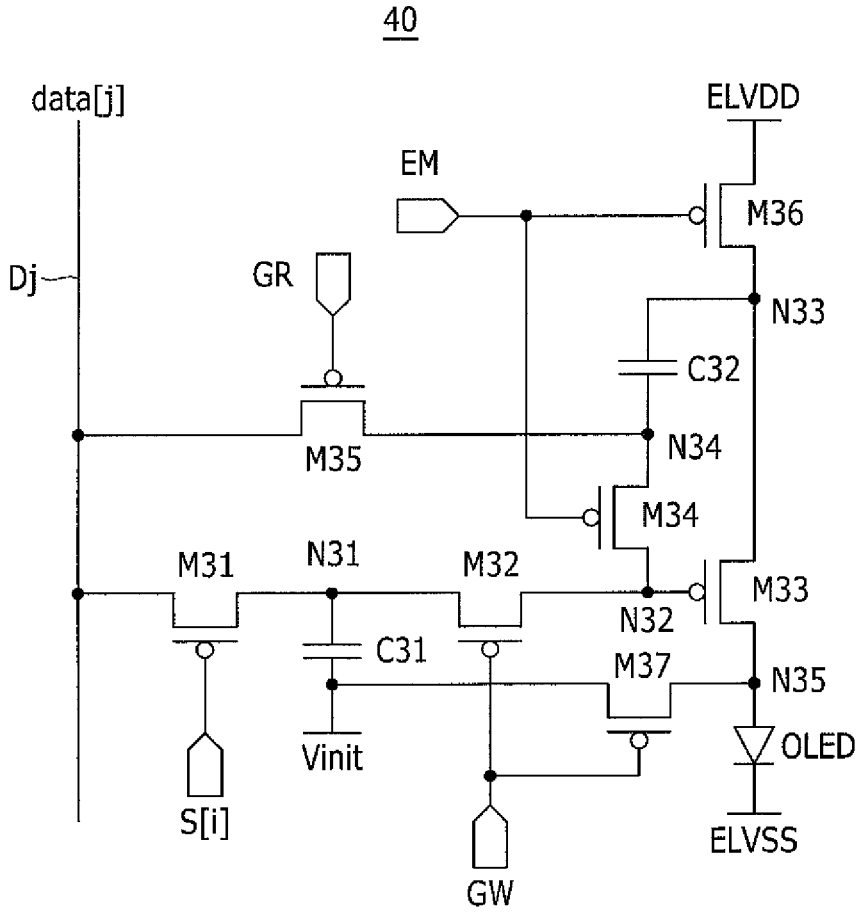
FIG. 7 is a circuit diagram illustrating a pixel according to an exemplary embodiment of the present invention.

FIG. 7 is a circuit diagram illustrating a pixel according to an exemplary embodiment of the present invention.

Referring to FIG. 7, a pixel 40 according to an exemplary embodiment of the invention includes a switching transistor M31, a relay transistor M32, a driving transistor M33, a first compensation transistor M34, a reset transistor M35, a light emitting transistor M36, a second compensation transistor M37, a first capacitor C31, a second capacitor C32, and an organic light emitting diode OLED.

Different from the pixel 20 illustrated in FIG. 6, the pixel 40 illustrated in FIG. 7 further includes the second compensation transistor M37.

The second compensation transistor M37 includes a gate electrode to which a writing signal GW is applied, an electrode which is connected to the initializing voltage Vinit, and another electrode which is connected to a fifth node N35. Another electrode of the driving transistor M33 and an anode of the organic emitting diode OLED are connected to the fifth node N35. The second compensation transistor M37 is turned on by the writing signal GW set to the gate on voltage to apply the initializing voltage Vinit to the fifth node N35.

The second compensation transistor M37 may be a p-channel field effect transistor. Here, even though it is described that the second compensation transistor M37 is a p-channel field effect transistor, the second compensation transistor M37 may be an n-channel field effect transistor.

The pixel 40 according to an exemplary embodiment may be driven in accordance with the waveform diagram illustrated in FIG. 4.

However, during the compensating period 2, the second compensation transistor M37 is turned on by the writing signal GW set to the gate on voltage and the initializing voltage Vinit of the low level voltage is applied to the fifth node N35 through the turned-on second compensation transistor M37. The voltage of the fifth node N35 becomes a low level voltage and the voltage of the third node N33 becomes the data-Vth voltage.

Other operations are the same as those described with reference to FIG. 4 and thus a detailed description of the driving method of the display device which includes the pixel 40 illustrated in FIG. 7 will be omitted.

Figure 8:
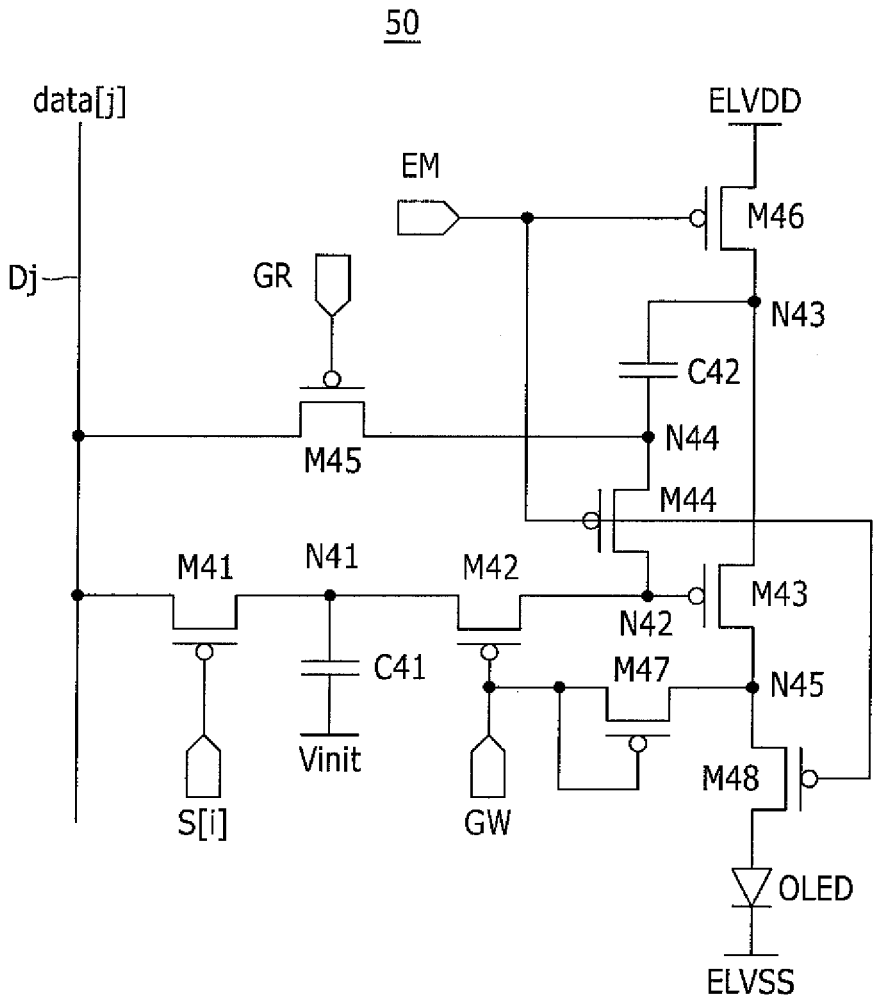
FIG. 8 is a circuit diagram illustrating a pixel according to an exemplary embodiment of the present invention.

FIG. 8 is a circuit diagram illustrating a pixel according to an exemplary embodiment of the present invention.

Referring to FIG. 8, a pixel 50 according to an exemplary embodiment of the inventive concept includes a switching transistor M41, a relay transistor M42, a driving transistor M43, a first compensation transistor M44, a reset transistor M45, a first light emitting transistor M46, a second compensation transistor M47, a second light emitting transistor M48, a first capacitor C41, a second capacitor C42, and an organic light emitting diode OLED.

Different from the pixel 20 illustrated in FIG. 3, the pixel 50 illustrated in FIG. 8 further includes the second compensation transistor M47 and the second light emitting transistor M48.

The second compensation transistor M47 includes a gate electrode to which a writing signal GW is applied, an electrode to which the writing signal GW is applied, and another electrode which is connected to a fifth node N45. The second compensation transistor M47 is turned on by the writing signal GW set to the gate on voltage to apply the writing signal GW set to the gate on voltage to a fifth node N45. Another electrode of the driving transistor M43 is connected to the fifth node N45.

The second light emitting transistor M48 includes a gate electrode to which the light emitting signal EM is applied, an electrode which is connected to the fifth node N45, and another electrode which is connected to the anode of the organic light emitting diode OLED.

The second compensation transistor M47 and the second light emitting transistor M48 may be p-channel field effect transistors. Here, even though it is described that the second compensation transistor M47 and the second light emitting transistor M48 are p-channel field effect transistors, at least one of the second compensation transistor M47 and the second light emitting transistor M48 may be an n-channel field effect transistor.

The pixel 50 according to an exemplary embodiment may be driven in accordance with the waveform diagram illustrated in FIG. 4.

However, during the compensating period 2, the second compensation transistor M47 is turned on by the writing signal GW set to the gate on voltage and the writing signal GW set to the gate on voltage (e.g., a low level voltage) is applied to the fifth node N45 through the turned-on second compensation transistor M47. The voltage of the fifth node N45 becomes a low level voltage and the voltage of the third node N43 becomes the data-Vth voltage. In this case, the light emitting signal EM of the gate off voltage is applied to the gate electrode of the second light emitting transistor M48 and the second light emitting transistor M48 is turned off to disconnect the fifth node N45 from the organic light emitting diode OLED.

The second light emitting transistor M48 is turned on by the light emitting signal EM set to the gate on voltage during the reset period 1 so that the anode of the organic light emitting diode OLED is reset to be a high level voltage. The second light emitting transistor M48 is turned on by the light emitting signal EM of the gate on voltage during the light emitting period 4 to allow a driving current Ioled to flow into the organic light emitting diode OLED.

Other operations are the same as those described with reference to FIG. 4 and thus a detailed description of the driving method of the display device which includes the pixel 50 illustrated in FIG. 8 will be omitted.

Figure 9:
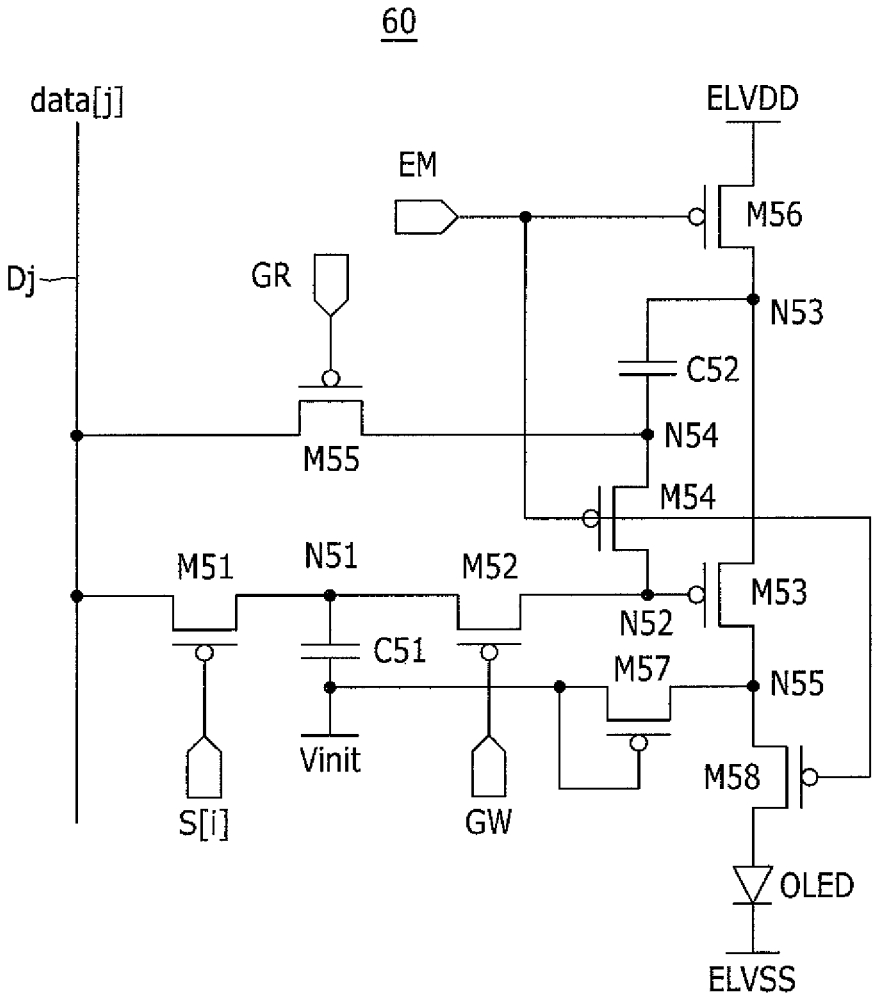
FIG. 9 is a circuit diagram illustrating a pixel according to an exemplary embodiment of the present invention.

FIG. 9 is a circuit diagram illustrating a pixel according to an exemplary embodiment of the present invention.

Referring to FIG. 9, a pixel 60 according to an exemplary embodiment includes a switching transistor M51, a relay transistor M52, a driving transistor M53, a first compensation transistor M54, a reset transistor M55, a first light emitting transistor M56, a second compensation transistor M57, a second light emitting transistor M58, a first capacitor C51, a second capacitor C52 and an organic light emitting diode OLED.

Different from the pixel 20 illustrated in FIG. 3, the pixel 60 illustrated in FIG. 9 further includes the second compensation transistor M57 and the second light emitting transistor M58.

The second compensation transistor M57 includes a gate electrode to which the writing signal GW is applied, an electrode which is connected to the initializing voltage Vinit, and another electrode which is connected to the fifth node N55. The second compensation transistor M57 is turned on by the writing signal GW set to the gate on voltage to apply the initializing voltage Vinit to a fifth node N55. Another electrode of the driving transistor M53 is connected to the fifth node N55.

The second light emitting transistor M58 includes a gate electrode to which the light emitting signal EM is applied, an electrode which is connected to a fifth node N55, and another electrode which is connected to the anode of the organic light emitting diode OLED.

The second compensation transistor M57 and the second light emitting transistor M58 may be p-channel field effect transistors. Here, even though it is described that the second compensation transistor M57 and the second light emitting transistor M58 are p-channel field effect transistors, at least one of the second compensation transistor M57 and the second light emitting transistor M58 may be an n-channel field effect transistor.

The pixel 60 according to an exemplary embodiment may be driven in accordance with the waveform diagram illustrated in FIG. 4.

However, during the compensating period 2, the second compensation transistor M57 is turned on by the writing signal GW set to the gate on voltage and the initializing signal Vinit of the low level voltage is transmitted to the fifth node N55 through the turned-on second compensation transistor M57. The voltage of the fifth node N55 becomes a low level voltage and the voltage of the third node N53 becomes the data-Vth voltage. In this case, the light emitting signal EM set to the gate off voltage is applied to the gate electrode of the second light emitting is transistor M58 and the second light emitting transistor M58 is turned off to disconnect the fifth node N55 from the organic light emitting diode OLED.

The second light emitting transistor M58 is turned on by the light emitting signal EM set to the gate on voltage during the reset period 1 so that the anode of the organic light emitting diode OLED is reset to be a high level voltage. The second light emitting transistor M58 is turned on by the light emitting signal EM of the gate on voltage during the light emitting period 4 to allow a driving current Ioled to flow into the organic light emitting diode OLED.

Other operations are the same as those described with reference to FIG. 4 and thus a detailed description of the driving method of the display device which includes the pixel 60 illustrated in FIG. 9 will be omitted.

In the pixel 20 illustrated in FIG. 3, the pixel 30 illustrated in FIG. 6, the pixel 40 illustrated in FIG. 7, the pixel 50 illustrated in FIG. 8, and the pixel 60 illustrated in FIG. 9, an organic emission layer of the organic light emitting diode OLED may be formed of a low molecular weight organic material or a high molecular organic material such as PEDOT (Poly 3,4-ethylenedioxythiophene). Further, the organic emission layer may be formed of a multilayer including at least one of a hole injection layer HIL, a hole transporting layer HTL, an electron transporting layer ETL, and an electron injection layer EIL. If the organic light emission layer includes all of the above layers, the hole injection layer HIL is disposed on a pixel electrode which is a positive electrode and the hole transport layer HTL, the emission layer, the electron transport layer ETL, and the electron injection layer EIL are sequentially laminated thereon.

The organic emission layer may include a red organic emission layer which emits a red light component, a green organic emission layer which emits a green light component, and a blue organic emission layer which emits a blue light component and the red organic emission layer, the green organic emission layer and the blue organic emission layer are formed in a red pixel, a green pixel, and a blue pixel to implement color images.

Further, in the organic emission layer, all of the red organic emission layer, the green organic emission layer, and the blue organic emission layer are laminated in the red pixel, the green pixel, and the blue pixel and a red color filter, a green color filter, and a blue color filter are formed for every pixel to implement color images. As an another example, a white organic emission layer which emits a white light component is formed in all of the red pixel, the green pixel, and the blue pixel and a red color filter, a green color filter, and a blue color filter are formed for every pixel to implement color images. When the color image is implemented using the white organic emission layer and the color filter, a deposition mask which deposits the red organic emission layer, the green organic emission layer and the blue organic emission layer in each pixel, that is, the red pixel, the green pixel, and the blue pixel does not need to be used.

The white organic emission layer described in another example may be formed of one organic emission layer or may also include a configuration in which a plurality of organic emission layers is laminated to emit a white light component. For example, at least one yellow organic emission layer and at least one blue organic emission layer may be combined to emit a white light component, or at least one cyan organic emission layer and at least one red organic emission layer may be combined to emit a white light component, or at least one magenta organic emission layer and at least one green organic emission layer may be combined to emit a white light component.

Further, in the pixel 20 illustrated in FIG. 3, the pixel 30 illustrated in FIG. 6, the pixel 40 illustrated in FIG. 7, the pixel 50 illustrated in FIG. 8, and the pixel 60 illustrated in FIG. 9, at least one of the plurality of transistors may be an oxide thin film transistor (oxide TFT) in which the semiconductor layer is formed of an oxide semiconductor.

The oxide semiconductor may include at least one of an oxide having titanium (Ti), hafnium (Hf), zirconium (Zr), aluminum (Al), tantalum (Ta), germanium (Ge), zinc (Zn), gallium (Ga), tin (Sn) or indium (In) as a base member and zinc oxide (ZnO), indium-gallium-zinc oxide (InGaZnO4), indium-zinc oxide (Zn—In—O), zinc-tin oxide (Zn—Sn—O), indium-gallium oxide (In—Ga—O), indium-tin oxide (In—Sn—O), indium-zirconium oxide (In—Zr—O), indium-zirconium-zinc oxide (In—Zr—Zn—O), indium-zirconium-tin oxide (In—Zr—Sn—O), indium-zirconium-gallium oxide (In—Zr—Ga—O), indium-aluminum oxide (In—Al—O), indium-zinc-aluminum oxide (In—Zn—Al—O), indium-tin-aluminum oxide (In—Sn—Al—O), indium-aluminum-gallium oxide (In—Al—Ga—O), indium-tantalum oxide (In—Ta—O), indium-tantalum-zinc oxide (In—Ta—Zn—O), indium-tantalum-tin oxide (In—Ta—Sn—O), indium-tantalum-gallium oxide (In—Ta—Ga—O), indium-germanium oxide (In—Ge—O), indium-germanium-zinc oxide (In—Ge—Zn—O), indium-germanium-tin oxide (In—Ge—Sn—O), indium-germanium-gallium oxide (In—Ge—Ga—O), titanium-indium-zinc oxide (Ti—In—Zn—O), and hafnium-indium-zinc oxide (Hf—In—Zn—O) which is a mixed oxide thereof.

The semiconductor layer may include a channel region in which an impurity is not doped and a source region and a drain region in which impurities are doped, at both sides of the channel region. Here, the impurity varies depending on a type of the thin film transistor and may include an N type impurity or a P type impurity.

When the semiconductor layer is formed of the oxide semiconductor, an additional passivation layer may be added to protect the oxide semiconductor from external environmental events (e.g., exposure to a high temperature).

While the invention has been described in connection with exemplary embodiments, it is to be understood that the invention is not limited to the disclosed embodiments, but on the contrary is intended to cover various modifications and equivalent arrangements included within the spirit and scope of the disclosure.

What is claimed is:

1. A display device comprising:

a plurality of pixels, wherein each of the plurality of pixels comprises:

a switching transistor comprising a gate electrode to which a scan signal is applied, an electrode directly connected to a data line receiving a data voltage, and another electrode connected to a first node;

a relay transistor comprising a gate electrode to which a writing signal is applied, an electrode connected to the first node, and another electrode connected to a second node;

a driving transistor comprising a gate electrode connected to the second node, an electrode connected to a third node, and another electrode connected to an organic light emitting diode;

a first capacitor comprising an electrode connected to the third node and another electrode connected to a fourth node;

a compensation transistor comprising a gate electrode to which a light emitting signal is applied, an electrode connected to the second node, and another electrode connected to the fourth node;

a reset transistor comprising a gate electrode to which a reset signal is applied, an electrode directly connected to the data line, and another electrode connected to the fourth node; and a light emitting transistor comprising a gate electrode to which the light emitting signal is applied, one electrode connected to a first power source voltage, and another electrode connected to the third node.

2. The display device of claim 1, wherein: each of the plurality of pixels further comprises a second compensation transistor comprising a gate electrode to which the writing signal is applied, an electrode to which the writing signal is applied, and another electrode connected to another electrode of the driving transistor.

3. The display device of claim 2, wherein: each of the plurality of pixels comprises a second light emitting transistor comprising a gate electrode to which the light emitting signal is applied, an electrode which is connected to another electrode of the driving transistor, and another electrode connected to the organic light emitting diode.

4. The display device of claim 1, wherein: each of the plurality of pixels further comprises a second compensation transistor comprising a gate electrode to which the writing signal is applied, an electrode connected to an initializing voltage, and another electrode connected to another electrode of the driving transistor.

5. The display device of claim 4, wherein: each of the plurality of pixels further comprises a second light emitting transistor comprising a gate electrode to which the light emitting signal is applied, an electrode which is connected to another electrode of the driving transistor, and another electrode connected to the organic light emitting diode.

6. The display device of claim 1, further comprising:

a second capacitor comprising an electrode connected to the first node and another electrode connected to an initializing voltage, wherein during an operation when the light emitting transistor and the compensation transistor are turned on and a voltage into which a first data voltage and a threshold voltage Vth of the driving transistor are reflected is applied to the second node, when a light emitting period when the organic light emitting diode emits light by a driving current which flows in the driving transistor is simultaneously performed in the plurality of pixels, a second data voltage corresponding to a scan signal set to a gate on voltage corresponding to each of the plurality of pixels is stored in the second capacitor.

7. The display device of claim 6, wherein: the second data voltage is a data voltage which is written into each of the plurality of the pixels in a current frame and the first data voltage is a data voltage which is written into each of the plurality of pixels in an immediately previous frame of the current frame.

8. The display device of claim 7, wherein: after the second data voltage is applied to the second node and a voltage into which the second data voltage and the threshold voltage of the driving transistor are formed in the third node, when the light emitting transistor and the compensation transistor are turned on, the voltage into which the data voltage and the threshold voltage of the driving transistor are reflected is applied to the second node by coupling of the first capacitor.

9. A driving method of a display device comprising a plurality of pixels, wherein each pixel comprises a switching transistor directly connected to a data line and a first node, a first capacitor connected between the first node and an initializing voltage, a relay transistor connected between the first node and a second node, a driving transistor comprising a gate electrode connected to the second node and configured to control a driving current flowing into an organic light emitting diode (OLED) by a first power source voltage applied to a third node, a light emitting transistor connected between the first power source voltage and the third node, a second capacitor connected between the third node and a fourth node, a compensation transistor connected between the second node and the fourth node, and a reset transistor directly connected to the data line and the fourth node, the method comprising:

during a scanning period of a first frame, turning off the relay transistor and turning on the switching transistor to enable a second data voltage applied to the data line to be stored in the first capacitor; and during a light emitting period of the first frame, performing an operation to turn on the light emitting transistor and the compensation transistor to enable a voltage into which a first data voltage and a threshold voltage of the driving transistor are reflected to be applied to the second node for enabling the organic light emitting diode OLED to emit light by the driving current which flows into the driving transistor, wherein the scanning period and the light emitting period temporally overlap each other.

10. The driving method of claim 9, wherein: the operation is simultaneously performed in the plurality of pixels.

11. The driving method of claim 9, wherein: the second data voltage is a data voltage which is written into each of the plurality of pixels in a current frame and the first data voltage is a data voltage which is written into each of the plurality of pixels in an immediately previous frame of the current frame.

12. The driving method of claim 9, further comprising: resetting a gate voltage of the driving transistor to an initializing voltage of a low level voltage.

13. The driving method of claim 12, wherein: the resetting comprises applying the initializing voltage to the data line, and turning on the reset transistor and the compensation transistor to apply the initializing voltage which is applied to the data line to the gate electrode of the driving transistor.

14. The driving method of claim 13, wherein: the resetting comprises applying the first power source voltage and the second power source voltage which is connected to a cathode of the organic light emitting diode (OLED) as high level voltages and applying a first power source voltage to an anode of the organic light emitting diode (OLED) when the light emitting transistor is turned on.

15. The driving method of claim 9, further comprising: before the scanning period, during a compensating operation in which the first data voltage which is stored in the first capacitor is applied to the second node and a voltage into which the first data voltage and the threshold voltage of the driving transistor are reflected is applied to the third node.

16. The driving method of claim 15, wherein: the compensation operation comprises applying a reference voltage to the data line and turning on the reset transistor to apply the reference voltage to the fourth node.

17. The driving method of claim 16, wherein: the compensation operation further comprises allowing a current to flow into the driving transistor until a second power source voltage which is applied to the cathode of the organic light emitting diode OLED is changed from the high level voltage into a low level voltage and a voltage of the third node becomes the first data voltage and the threshold voltage of the driving transistor.

18. The driving method of claim 16, wherein: the compensation operation further comprises turning on a second compensation transistor connected between the writing signal and the organic light emitting diode (OLED) to apply the writing signal to an anode of the organic light emitting diode (OLED).

19. The driving method of claim 18, wherein: the compensation operation further comprises turning on a second light emitting transistor connected between the driving transistor and the organic light emitting diode (OLED).

20. The driving method of claim 16, wherein: the compensation operation comprises turning on a second compensation transistor connected between the writing signal and the organic light emitting diode (OLED) to apply the initializing signal to the anode of the organic light emitting diode (OLED); and turning on a second light emitting transistor connected between the driving transistor and the organic light emitting diode (OLED).

21. A display device comprising:

a pixel comprising first through sixth transistors and an organic light emitting diode OLED, the first and fifth transistors directly connected to a data line receiving a data voltage, a gate electrode of the first transistor connected to a scan line;

a power supply configured to provide a first power supply voltage to the sixth transistor and a second power supply voltage to the OLED; and a controller configured to provide a scan signal to the scan line, a first signal to a gate terminal of the second transistor, a second signal to gate electrodes of the fourth and sixth transistors, and a third signal to a gate terminal of the fifth transistor, wherein during an entire light emitting period the first and third signals have a first logic level and the second signal has a second other logic level, during a first part of the period the scan signal has a gate off voltage, during a second part of the period the scan signal has a gate on voltage, and during a third part of the period the scan signal has the gate off voltage.

22. The display device of claim 21, wherein the first transistor is connected to a first node, the second transistor is connected between the first node and a second node, the third transistor is connected between the OLED and a third node, the fourth transistor is connected between the second node and a fourth node, the fifth transistor is connected to the fourth node, and the sixth transistor is connected to the third node.

23. The display device of claim 22, wherein the pixel further comprises:

a first capacitor connected to the first node; and a second capacitor connected between the third and fourth nodes.

24. The display device of claim 21, wherein during the first part a constant high voltage is applied to the data line, during the second part a voltage with one among a plurality of levels representing a gray level of the pixel is applied to the data line, and during the third part a constant low voltage is applied to the data line.

* * * * *